US006543327B1

(12) United States Patent
Mueller, Sr.

(10) Patent No.: US 6,543,327 B1
(45) Date of Patent: Apr. 8, 2003

(54) METHOD AND APPARATUS FOR RECYCLING ENERGETIC MATERIALS

(76) Inventor: Edward C. Mueller, Sr., 51 Ethelbert Pl., Ridgewood, NJ (US) 07450-4228

( * ) Notice: Subject to any disclaimer, the term of this patent is extended or adjusted under 35 U.S.C. 154(b) by 0 days.

(21) Appl. No.: 09/834,232

(22) Filed: Apr. 12, 2001

(51) Int. Cl.[7] ..... F23B 3/00
(52) U.S. Cl. ..... 86/50; 588/202
(58) Field of Search ..... 86/50, 1.1; 588/202

(56) References Cited

U.S. PATENT DOCUMENTS

| | | | | |
|---|---|---|---|---|
| 3,607,227 A | | 9/1971 | Blaskowski | 75/26 |
| 3,830,172 A | | 8/1974 | Hindenlang | 110/7 S |
| 4,015,546 A | | 4/1977 | Paules | 110/8 A |
| 4,236,464 A | | 12/1980 | Anderson et al. | 110/238 |
| 4,241,671 A | | 12/1980 | Joyner et al. | 110/188 |
| 4,785,748 A | | 11/1988 | Sujata et al. | 110/238 |
| 5,029,557 A | | 7/1991 | Korenberg | 122/149 |
| 5,209,187 A | | 5/1993 | Khinkis | 122/136 |
| 5,471,957 A | * | 12/1995 | Brady et al. | 122/367.1 |
| 5,648,052 A | * | 7/1997 | Schaefer et al. | 422/305 |
| 5,649,325 A | | 7/1997 | Garrison et al. | 588/202 |
| 5,727,482 A | | 3/1998 | Young | 110/244 |
| 5,791,266 A | | 8/1998 | Fleming et al. | 110/237 |

FOREIGN PATENT DOCUMENTS

| | | | | |
|---|---|---|---|---|
| DE | 40 41 744 C1 | * | 10/1991 | 86/50 |
| WO | WO 93/17295 | * | 9/1993 | 86/50 |

* cited by examiner

*Primary Examiner*—Stephen M. Johnson
(74) *Attorney, Agent, or Firm*—Wolff & Samson, P.C.

(57) ABSTRACT

The present invention provides a method and apparatus for recycling energetic materials. Energetic materials are intruded into a reaction chamber through a plurality of nozzles positioned at angles on an end plate of a reaction chamber to introduce the energetic materials into the reaction chamber in a cyclonic manner. The energetic materials are combusted in the reaction chamber, and the heat associated with the reaction/combustion is transferred for creating usable power, such as electricity.

10 Claims, 3 Drawing Sheets

METHOD AND APPARATUS FOR RECYCLING ENERGETIC MATERIALS

BACKGROUND OF THE INVENTION

1. Field of the Invention

The present invention generally relates to a method and apparatus for recycling energetic materials, and more particular to a method and apparatus which can be used to dispose of old, unwanted energetic materials, and convert the energy stored in the energetic materials to a useable form.

2. Related Art

Energetic materials are highly volatile materials used in explosives, propellants, pyrotechnics, and the like. Energetic materials have been stockpiled throughout the world since as far back as before World War I. These materials are toxic and/or hazardous, obsolete and degraded. Accordingly, these materials must be, and are being, disposed of.

One way in which energetic materials are disposed is by burning, or otherwise destroying them. However, it is hard to control the burning of energetic materials because of their fast, unpredictable burn rates. Because may do not need oxygen to burn, combustion cannot be regulated by regulating air flow. Further, open air burning is not only dangerous, it is potentially environmentally harmful. Likewise, destroying such materials by using them, i.e. shooting off the explosives, is an unacceptable approach because it is inefficient and dangerous.

Another way that energetic materials have been incinerated is by mixing with water to form a slurry and then incinerating the slurry. However, there are numerous problems associated with slurry incineration, including, unpredictability, danger, mixing problems and waste of energy.

What is needed, but has not heretofore been provided is a safe, efficient and environmentally friendly method of disposing of unwanted energetic materials, while capturing the energy of the materials in a usable form.

OBJECTS AND SUMMARY OF THE INVENTION

It is an object of the present invention to provide a method and apparatus for recycling energetic materials.

It is another object of the present invention to provide a method and apparatus for recycling energetic materials which is safe.

It is another object of the present invention to provide a method and apparatus for recycling energetic materials which is efficient.

It is a further object of the present invention to provide a method and apparatus for recycling energetic materials which provides for complete combustion of the energetic materials.

It is even a further object of the present invention to provide a method and apparatus for recycling energetic materials which is environmentally friendly.

It is still another object of the present invention to provide a method and apparatus for recycling energetic materials which recaptures the energy in a usable form.

It is even another object of the present invention to provide a method and apparatus for recycling energetic materials which can be conducted on a continuous flow or batch (pulse and breach) basis.

The present invention provides a method and apparatus for recycling energetic materials. Energetic materials are intruded into a reaction chamber through a plurality of nozzles positioned at angles on an intake portion of a reaction chamber to introduce the energetic materials into the reaction chamber in a cyclonic manner. The energetic materials are combusted in the reaction chamber, and the heat associated with the reaction/combustion is transferred for creating usable power, such as electricity.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a method and apparatus for recycling energetic materials. Energetic materials are intruded into a reaction chamber through a plurality of nozzles positioned at angles on an intake end of the reaction chamber to introduce the energetic materials into the reaction chamber in a cyclonic manner. The energetic materials are reacted/combusted in the reaction chamber, moving through in a cyclonic flow pattern, and the heat associated therewith is used for creating usable power, such as electricity.

Figure 1:
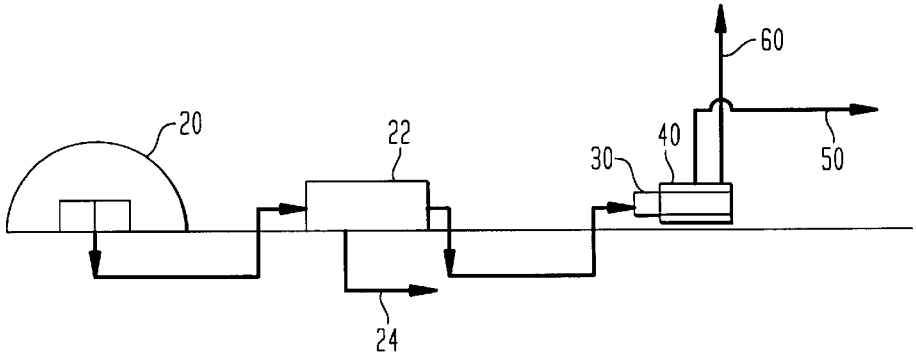
FIG. 1 is a schematic of the process of the present invention.

FIG. 1 is a schematic of the process of the present invention. Energetic materials stored in a storage magazine 20 are transferred to a grain sizing station 22 for sorting. Containers, in which the energetic materials may be stored, are cleaned out 24 and then the sorted energetic materials are fed to reactor nozzles 30 into reaction chamber 40 containers that are combustable can be cut to size and fed into the reaction chamber 40 with the energetic materials. The energetic materials can be fed into the reaction chamber 40, through nozzles 30, by any known feed device, including, but not limited to, positive gear worm feeding devices, or injection feed devices. The energetic materials are fully reacted in the reaction-chamber 40. The cyclonic flow of the energetic materials through the reaction chamber 40 helps to insure this. Heat recovery occurs at 50 to create useful energy, and clean effluent ($CO_2$, N, and $H_2O$) is vented to atmosphere at 60. Importantly, the standards for handling explosive materials during the recycling process are identical to those standards used for ammunition production.

Figure 2:
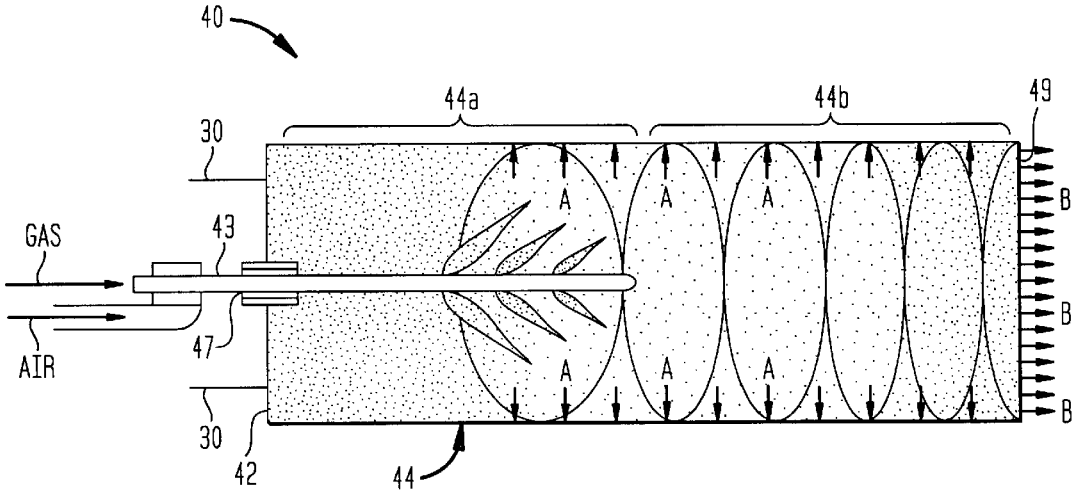
FIG. 2 is a schematic of a cross-section of the reaction chamber shown in FIG. 1.

FIG. 2 is a schematic of a cross-section of the reaction chamber 40 used in connection with the present invention. The reaction chamber 40 includes an inlet end 42 that could include a face plate. One or more nozzles 30 are attached to the inlet end 42. The reaction chamber 40 includes a central cylindrical zone 44 and an exhaust end 49. The central cylindrical zone 44 includes an ignition and reaction portion 44*a* wherein cyclonic flow is established, and a heat or vortex portion 44*b*, wherein cyclonic flow is maintained. In operation, energetic materials are introduced under pressure through the nozzles 30 to the central cylindrical zone 44 of the reaction chamber 40. Throughout the central cylindrical zone 44, hot gas progresses in a spiral or cyclonic flow through both the reaction portion 44*a* and the heat portion 44*b*. A retractable fuel gas nozzle 43 may be provided for start-up heat and for air injection for oxydizing residual particulates. When not in use, the nozzle 43 can be retracted from the reaction chamber 40. The nozzle 43 is inserted through inlet 47 and can be used to add gas or air to the reaction chamber 40 through apertures in the inserted end. The reaction is exothermic and heat created, indicated by arrows A, flows through the walls of the reaction chamber 40 to power a steam or hot water generator to create usable energy. Arrows B indicate clean exhaust leaving the reaction chamber 40. Of course, the exhaust would be monitored for compliance with environmental regulations. Nozzles 30, as will be hereinafter described, are preferably fuel gun nozzles for centrifuging molecular products of exothermal reaction. The central cylindrical zone 44 is of standard construction, preferably made of steel and preferably at least thirty eight inches in diameter or greater, and designed to be placed on a train for mobility. The reaction chamber 40 is positioned within a conventional steam or hot water generator for transforming the heat of reaction into usable energy. It should also be pointed out that the reaction process can be a continuous flow process or a batch (pulse and breach) process.

Figure 3A:
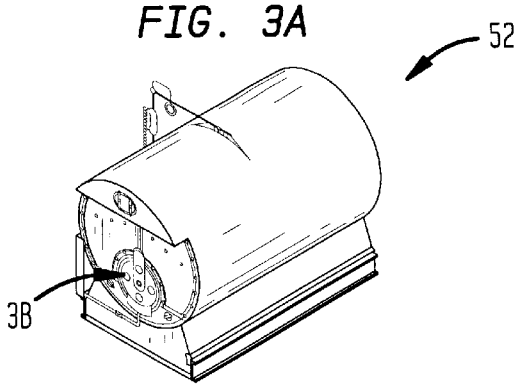
FIG. 3*a* is a perspective view of a steam/hot water generator for housing the reaction chamber shown in FIG. 2.

FIG. 3*a* is a perspective view of a conventional steam/hot water generator 52 for housing the reaction chamber 40. One appropriate generator is manufactured by Johnson Boiler Company, for example the 509 Series 3-Pass Steam Packaged Firetube Boiler (PFT). Other "packaged" steam boilers from other industrial boiler companies would also be acceptable. For example, Cleaver & Brooks has a standard unit having a furnace tube with a thirty four inch outer diameter and a capacity of 8,250,000 BTU/Hr.

Figure 3B:
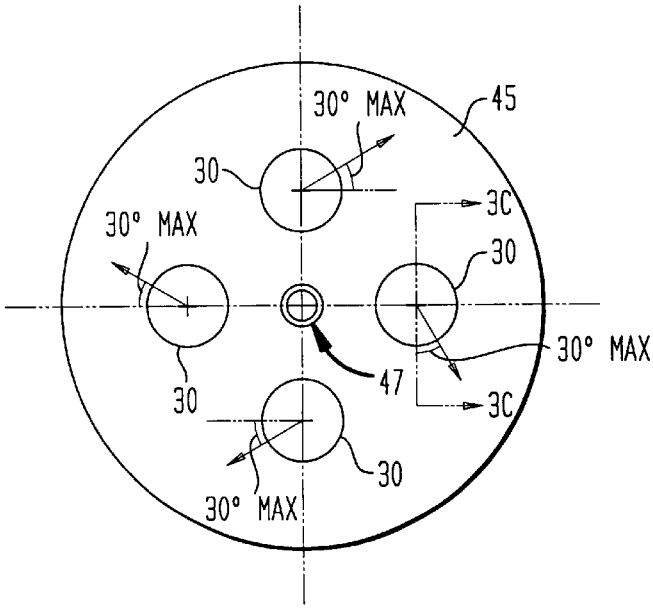
FIG. 3*b* is a schematic of the face or face plate of the reaction chamber showing nozzles interconnected therewith.

FIG. 3*b* is a schematic of the face or face plate 45 on the inlet end of the reaction chamber showing nozzles 30 interconnected therewith. The nozzles 30 are positioned about the face plate 45, as shown, or as otherwise desired. A gas fuel inlet 47 may be provided in the face plate 45 to allow for insertion of a retractable fuel gas nozzle. The fuel gas nozzle 43 is designed to inject gas or air into the reaction chamber if either is needed to facilitate complete reaction of the energetic materials.

Figure 3C:
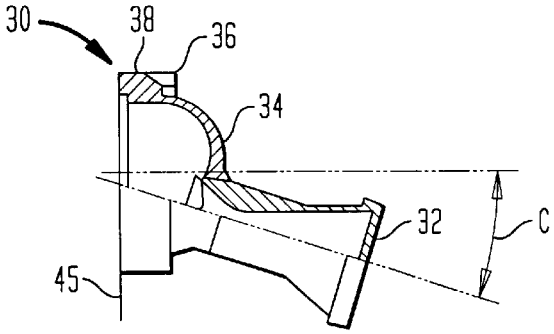
FIG. 3*c* is a partial cross-section of a nozzle shown in FIG. 3*b* taken along the line 3*c*—3*c*.

FIG. 3*c* is a partial cross-section of a nozzle 30 taken along the line 3*c*—3*c* of FIG. 3*b*. The nozzle 30 is interconnected with the face plate 45 at an angle C from normal to the face plate 45 for discharging energetic materials into the reaction chamber at an angle to create a cyclonic flow within the reaction chamber. The angle of the nozzle 30 is preset for the fuel being reacted, but the orientation can be adjusted as desired, preferably to create an ideal cyclonic flow within the reaction chamber. Generally, the nozzle requirement for rocket propellants, projectile propellants and HE explosives is one set of four nozzles. For pyrotechnic/guns, one set of two nozzles should be sufficient. The nozzle 30 includes outlet 32 directed into the reaction chamber, aft head 34, nozzle orientation lug 36 for locking down the angle of the nozzle 30, and a positioning or retainer key 38 for adjusting the angle of the nozzle 30.

The nozzles 30 must be of sufficient strength to withstand the forces associated with the reaction of the energetic materials. Nozzles similar to those used for rocket propulsion are ideal. Accordingly, Jet Assistance Take Off (JATO) nozzles, which are stored and stocked at Crane Army Ammunition Activity at Crane, Indiana, would work well. Such nozzles are generally about five inches in diameter. However, it should be known that any nozzle can be used that can inject energetic materials into a reaction chamber at an angle, and yet withstand the pressure associated with the reaction. Nozzles would preferrably each have flow rates of about 420 lbs/hr. Four nozzles would therefor process 1680 lbs/hr. Feed rates could be as follows:

Feed Rate to each nozzle on reactor nozzle plate:

| | Per Nozzle | 4 Nozzles | 6 Nozzles |
|---|---|---|---|
| Pounds/hour/nozzle | 420 | 1680 | 2520 |
| Pounds/minute/nozzle | 7.0 | 28 | 42 |
| Ounces/minute/nozzle | 112.0 | | |
| Grains/minute/nozzle | 49,000 | | |
| Grains/feed (6 feed/min) | 8,167 | | |
| Ounces/feed/nozzle | 18.66 | | |

Figure 4A:
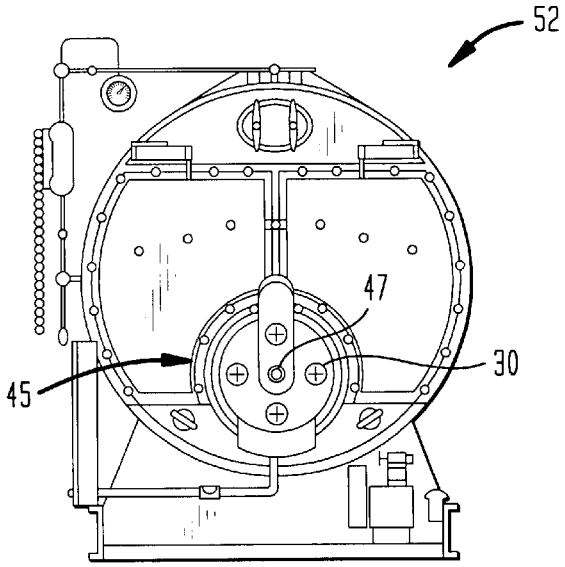
FIG. 4*a* is front plan view of the generator shown in FIG. 3*a*.
Figure 4B:
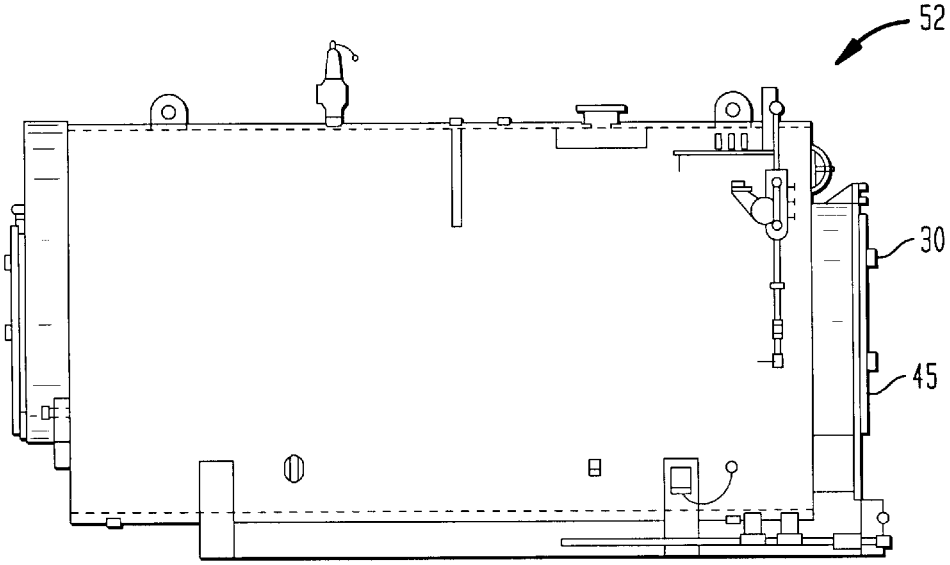
FIG. 4*b* is a side plan view thereof.

FIG. 4*a* is front plan view of the generator 52 showing the face plate 45, nozzles 30 and gas fuel inlet 47. FIG. 4*b* is a side plan view thereof. Heat is transferred from the reaction chamber 40 to the generator 52 as is known in the art, and converted by the generator to a usable form. As an example, for a generator capable of 6,695,000 BTU/Hr, the width F would likely be about seven feet five inches, the length about ten feet eleven inches, and the height about six feet. Of course, size will vary by manufacturer, model and capacity. Sample rates of disposal could be as follows:

Rates of Disposal for Gun Propellant Disposal:

| | | |
|---|---|---|
| Heat value of propellant | 4000 | BTU/Pound (min) |
| Pounds/Hour/Reactor | 1680 | Pounds/Hr/Reactor |
| Heat rate per hour | 6,720,000 | BTU/hour |
| Pounds per day (16-hour day) | 26,880 | Pounds/day/reactor |
| Pounds per week (5-day week) | 134,400 | Pounds/week/reactor |
| Tons per year (50-week year, 2000 lb) | 3,360 | Ton/year/reactor |
| Annual tons per installation (3 reactor) | 10,080 | Ton/year/plant |

Four groups of energetics: propellants for/from rockets; propellants for/from tube fired projectiles; explosives for/from conventional weapons; and pyrotechnics (colors and smoke). Because of deterioration, specific lots may require laboratory tests of samples to determine BTU values. Process feed rates can then be modulated as necessary. Solid rocket propellants can be handled by the method of the present invention, but the metal solids, i.e. aluminum, must be separated from the hot stream before effluent is released.

There are two basic classes of explosives: mechanical mixtures and chemical compounds. Mechanical mixtures are intimate mixtures of combustibles, such as carbon and sulphur, with an oxygen supplier such as potassium nitrate. An example of a mechanical mixture is gunpowder, which typically contains 75% potassium nitrate, 15% charcoal and 10% sulpher. Chemical compounds are compositions wherein each molecule comprising the composition contains the necessary oxygen atoms for the oxydation of the carbon and hydrogen in the carbo-hydrate. An examples of an explosive chemical compound is gun cotton with nitro-glycerine. The oxygen in the nitro-glycerine is in a feeble combination with its nitrogen. The reactions are as follows:

| Energetic Reactant | Formula |
|---|---|
| Nitrated Cotton | $C_{24}H_{32}O_{12}(NO_3)_8$ |
| Gun Cotton (Super Nitrated) | $C_{24}H_{28}O8(NO_3)_{12}$ |

| Reaction Gases (In Contained High Temperature Reactor Using Cyclonic Molecular Dynamics | |
|---|---|
| With Air Injection: | $14\ CO_2$ } $+ O_2 \rightarrow 24\ CO_2$ |
| Oxygen added | $10\ CO$ |
| | $6\ N_2 +$ |
| Plus/With Steam Injection: | $8\ H_2 + O_2 \rightarrow 14\ H_2O$ |
| From Explosion Only: | $14\ CO_2$ |
| | $10\ CO$ |
| | $6\ N_2$ |
| | $8\ H_2 + O_2 \rightarrow 14\ H_2O$ |

Having thus described the invention in detail, it is to be understood that the foregoing description is not intended to limit the spirit and scope thereof. What is desired to be protected by Letters Patent is set forth in the appended claims.

What is claimed is:

1. An apparatus for recycling energetic materials comprising:

a generator;

a reaction chamber within the generator;

an inlet end on the reaction chamber, the inlet end having one or more nozzles, the one or more nozzles each positioned at an angle with respect to normal to the inlet end for injecting energetic materials into the reaction chamber at an angle;

a cyclonic flow pattern created within the reaction chamber by injecting the energetic materials through the angled nozzles;

means for transferring heat generated by reacting the energetic materials in the reaction chamber to the generator; and an exhaust for exhausting byproducts of the reacted energetic materials.

2. The apparatus of claim 1 wherein the angle of the nozzle with respect to normal to the inlet end can be adjusted.

3. The apparatus of claim 2 wherein four nozzles are positioned about the inlet end of the reaction chamber.

4. The apparatus of claim 2 further comprising a fuel gas nozzle extendable through the inlet end for injecting fuel or gas into the reaction chamber.

5. The apparatus of claim 4 wherein the fuel gas nozzle is retractable from the reaction chamber.

6. An apparatus for recycling energetic materials comprising:

a reaction chamber;

an inlet end on the reaction chamber, the inlet end having one or more nozzles, the one or more nozzles each positioned with respect to normal to the inlet end for injecting energetic materials into the reaction chamber;

a cyclonic flow pattern created within the reaction chamber by injecting the energetic materials through the one or more nozzles;

heat transfer means for transferring heat generated by reacting the energetic materials in the reaction chamber to a generator; and an exhaust for exhausting by-products of the reacted energetic materials.

7. The apparatus of claim 6, wherein the angle of the one or more nozzles with respect to normal to the inlet end can be adjusted.

8. The apparatus of claim 7, wherein the one or more nozzles comprise four nozzles are positioned about the inlet end of the reaction chamber.

9. The apparatus of claim 6, further comprising a fuel gas nozzle extendable through the inlet end for injecting fuel or gas into the reaction chamber.

10. The apparatus of claim 9, wherein the fuel gas nozzle is retractable from the reaction chamber.

* * * * *